US008437488B2

(12) United States Patent
Hasler et al.

(10) Patent No.: US 8,437,488 B2
(45) Date of Patent: May 7, 2013

(54) HEARING INSTRUMENT AND INPUT METHOD FOR A HEARING INSTRUMENT

(75) Inventors: Ivo Hasler, Winterthur (CH); Andi Vonlanthen, Oberrohrdorf (CH); Bruno Gabathuler, Grüningen (CH)

(73) Assignee: Phonak AG, Stafa (CH)

( * ) Notice: Subject to any disclaimer, the term of this patent is extended or adjusted under 35 U.S.C. 154(b) by 548 days.

(21) Appl. No.: 12/664,068

(22) PCT Filed: Jun. 12, 2007

(86) PCT No.: PCT/CH2007/000293

§ 371 (c)(1),
(2), (4) Date: Jun. 11, 2010

(87) PCT Pub. No.: WO2007/093075

PCT Pub. Date: Aug. 23, 2007

(65) Prior Publication Data

US 2010/0260367 A1 Oct. 14, 2010

(51) Int. Cl.
*H04R 25/00* (2006.01)

(52) U.S. Cl.
USPC ..... 381/323; 381/322

(58) Field of Classification Search ..... 381/322, 381/323, 324; 607/28
See application file for complete search history.

(56) References Cited

U.S. PATENT DOCUMENTS

| | | | | |
|---|---|---|---|---|
| 6,097,825 | A | 8/2000 | Yoest et al. | |
| 2005/0157898 | A1 * | 7/2005 | Gabathuler | 381/322 |
| 2007/0019817 | A1 | 1/2007 | Siltmann | |
| 2008/0195169 | A1 * | 8/2008 | Pinter et al. | 607/28 |

FOREIGN PATENT DOCUMENTS

| | | | |
|---|---|---|---|
| CH | 673366 | A5 | 2/1990 |
| EP | 1435758 | A1 | 7/2004 |
| EP | 1571878 | A1 | 9/2005 |
| WO | 2006010378 | A1 | 2/2006 |
| WO | 2006092767 | A1 | 9/2006 |

OTHER PUBLICATIONS

International Search Report for PCT/CH2007/000293 dated Feb. 4, 2008.

Written Opinion for PCT/CH2007/000293 dated Feb. 4, 2008.

* cited by examiner

*Primary Examiner* — Davetta W Goins
*Assistant Examiner* — Amir Etesam
(74) *Attorney, Agent, or Firm* — Pearne & Gordon LLP

(57) ABSTRACT

A hearing instrument comprises an openable cover lid, the cover lid comprising at least one electrical input element and at least one lid contact terminal arranged to physically and electrically contact at least one corresponding device contact terminal when the lid is in a closed position. The cover lid further comprises at least two electrical input, each of the at least two input elements being functionally associated with the impedance between the lid contact terminal and a further terminal, and the hearing instrument comprises means to infer the state of the input elements from said impedance. In a preferred embodiment, the number of input elements is equal to or larger than the number of lid contact terminals. In a further embodiment, the lid is the lid of a battery compartment of the hearing instrument, and in a closed position of the lid at least one of the input elements is in electrical contact with one of the terminals of a battery lying in the battery compartment.

23 Claims, 5 Drawing Sheets

HEARING INSTRUMENT AND INPUT METHOD FOR A HEARING INSTRUMENT

FIELD OF THE INVENTION

The invention relates to the field of hearing instruments, and in particular to a hearing instrument and an input method for a hearing instrument as described in the preamble of the corresponding independent claims.

BACKGROUND OF THE INVENTION

It is known from EP 1 435 758 A2 to incorporate input elements such as switches into the lid of a hearing instrument, e.g. the lid of its battery compartment. When the lid is moved into a closed position, two contact elements of the lid get into electrical contact with corresponding contact elements of the hearing instrument's body. The number of different functions, e.g. switches or potentiometers, that can be incorporated in the lid is limited by the number of contact elements. It is desirable to have a variety of different input elements on the lid while keeping the number of contact elements as low as possible.

In many hearing instruments the integrated circuits (ICs) and the passive components like surface mounted device (SMD) resistors and capacitors are combined in a subassembly or electronic circuit assembly, also called a hybrid circuit. Such a hybrid circuit is combined with electromechanical components such as manual switches, and electro-acoustic components such as microphones and loudspeakers to constitute a hearing instrument.

It is desirable to minimise the number of input/output (IO) contacts that are needed to interface the hybrid circuit with the other components. Each such contact requires a bonding pad for contacting a conductor such as a wire to the hybrid circuit. This takes up space on the circuit and necessitates a bonding operation, increasing cost and reducing reliability.

Typical input devices for a hearing instrument are analog and digital wheels, various types of switches, including e.g. push buttons, seesaw switches, locking (engaging) and non-locking switches. Each switch requires one associated IO contact. The switch, when closed, connects the IO contact to a reference voltage such as ground.

The term "hearing instrument" or "hearing device", as understood here, denotes on the one hand hearing aid devices that are medical devices improving the hearing ability of individuals, primarily according to diagnostic results. Such hearing aid devices may be outside-the-ear hearing aid devices or in-the-ear hearing aid devices. On the other hand, the term stands for devices which may improve the hearing of individuals with normal hearing e.g. in specific acoustical situations such as in a very noisy environment or in concert halls, or which may even be used in context with remote communication or with audio listening, for instance as provided by headphones.

The hearing devices as addressed by the present invention are so-called active hearing devices which comprise at the input side at least one acoustical to electrical converter, such as a microphone, at the output side at least one electrical to mechanical converter, such as a loudspeaker, and which further comprise a signal processing unit for processing signals according to the output signals of the acoustical to electrical converter and for generating output signals to the electrical input of the electrical to mechanical output converter. In general, the signal processing circuit may be an analog, digital or hybrid analog-digital circuit, and may be implemented with discrete electronic components, integrated circuits, or a combination of both.

DESCRIPTION OF THE INVENTION

It is therefore an object of the invention to create a hearing instrument and input method for a hearing instrument in which multiple input elements in a lid that is insertable into the hearing instrument body are connectable to the hearing instrument body by a minimum of electrical contacts.

It is a further object of the invention to create a hearing instrument incorporating an input arrangement and input method for an electronic circuit assembly with a reduced number of IO contacts. A further object of the invention is to create a switch assembly unit comprising a reduced number of IO contacts.

It is a further object of the invention to create a hearing instrument which can distinguish between a plurality of lids switch assembly units having different configurations of input elements.

It is further object of the invention to create a hearing instrument which can be reconfigured in a simple manner and with simple means.

It is yet a further object of the invention to create a hearing instrument which can also distinguish whether a lid with input elements is replaced by a connector to a programming device.

These and further objects are achieved by a hearing instrument and an input method for a hearing instrument according to the invention and its preferred embodiments.

The hearing instrument comprises a openable or removable cover lid, the cover lid comprising at least one electrical and/or electronic input element and at least one lid contact terminal arranged to physically and electrically contact at least one corresponding device contact terminal when the lid is in a closed position. The cover lid comprises at least two electrical input elements, each of the at least two input elements being functionally associated with the impedance between the lid contact terminal and a further terminal. The hearing instrument further comprises means to infer the state of the input elements from said impedance.

In other words, the at least two input elements, according to their respective status, determine the impedance that may be observed between the two terminals. The impedance may be purely resistive, or may have a reactive (inductive and/or capacitive) component as well. Furthermore, the impedance may be asymmetric, i.e. depend on the polarity of the voltage applied to determine the impedance.

In a preferred embodiment of the invention, the number of input elements is equal to or larger than the number of lid contact terminals.

In a further preferred embodiment of the invention, the lid is the lid of a battery compartment of the hearing instrument, and in a closed position of the lid at least one of the input elements is in electrical, in particular in galvanic contact with one of the terminals of a battery located in the battery compartment.

The hearing instrument preferably comprises an input arrangement for an electronic circuit, which input arrangement in turn comprises

- a first input line and a second input line,
- a first switch and a second switch,
- the first switch being configured to connect, in a closed position, the first input line to a common reference voltage, the second switch being configured to connect, in a closed position, the second input line to the common reference voltage, the first and second switch being arranged such that during normal operation of the circuit at most one of them is in the closed position.

The input arrangement further comprises a third switch arranged to connect, in a closed position, the first input line with the second input line, a first pull circuit configured to pull, when it is activated, the voltage of the first input line to a first reference voltage, and to pull, when it is not activated, the voltage of the first input line to a voltage different from the first reference voltage, a second pull circuit configured to pull, when it is activated, the voltage of the second input line to a second reference voltage, and to pull, when it is not activated, the voltage of the second input line to a voltage different from the second reference voltage, and a status evaluation logic configured to determine the status of the third switch by repeatedly activating, for first time periods, the first pull circuit and, for second time periods, the second pull circuit and by determining, during the first time periods, the voltage of the second input line, and, during the second time periods, the voltage of the first input line, and by indicating that the third switch is closed either, if and only if said voltages both are substantially equal to the common reference voltage, with the first and second reference voltage being equal to the common reference voltage, or, if during the first time periods, a signal on the second input line corresponds to a signal determined by the first pull circuit, or, if during the second time periods, a signal on the first input line corresponds to a signal determined by the second pull circuit.

Since the first and second switches are not closed at the same time, the voltages on the first and second line are forced to be equal only when third switch is closed. The presence of this connection is detected by driving one line to the reference voltage and checking whether the other line carries the same voltage. Alternatively, a specific signal such as a first or second reference voltage or a time-varying reference signal on one line can be observed on the other line only if the third switch is closed. The time-varying reference signal is e.g. generated by, during the first (second) time periods, intermittently pulling the first (second) input line to the first (second) reference voltage according to a predetermined time pattern.

In other words, the property that both of the pair of switches are not closed simultaneously is exploited to identify the state of the third switch. If both switches of the pair would be closed simultaneously, thus connecting the two input lines to the reference voltage, then this state would be indistinguishable from the third switch being closed. When the third switch itself is closed, it is not possible to determine the state of the other two switches. Since the third switch is non-locking, and since the user is not expected to press several switches simultaneously, this is not a serious problem.

In a preferred variant of the invention, the pair of switches is operatively connected, e.g. mechanically, such that at most one of them can be in the closed position. Alternatively, the switches may be arranged on the surface of a hearing instrument such that it is very difficult to press both of the switches at the same time. For example, the pair of switches is part of a digital wheel or of a seesaw switch. A digital wheel, when it is being turned in one direction, intermittently opens and closes a first one of the switches. When turned in the other direction, it opens and closes a second one of the switches. A seesaw switch comprises a single lever which may be moved from a central position into a first position, closing the first switch, or into a second position, closing the second switch. Logic circuitry or a program running on the circuit determines a value of a scalar variable according to the number of times the switches are closed, or according to the length of time they are closed. That is, the value is increased when the first switch is activated and is decreased when the second switch is activated. The increase/decrease happens whenever a switch is activated, that is, only for a rising or falling edge of the line voltage, or continually, or as long as a switch is activated.

In a preferred embodiment of the invention, the first and second time periods are shorter than the shortest time span for which the first switch and second switch are closed during normal operation, e.g. ten to a hundred to a thousand times smaller. For example, whereas the duration for which the first switch and second switch are closed is in the range of milliseconds, the first and second time periods can be controlled to be in the range of microseconds, e.g. 50 microseconds.

The first and second time periods are arranged to be close to one another such that e.g. the first time period is followed by a second time period after a very short changeover time, and then the next first time period follows after a longer waiting time. The changeover time is kept small in order to minimise the chance of a change of state of the third switch occurring. During the waiting time, the input circuitry processes the line signals as usual, determining the scalar variable as if only a digital wheel or seesaw switch were present. The waiting time is, on the one hand, long enough in order not to interfere with this processing, and on the other hand short enough to allow prompt detection of a change of state of the third switch. The waiting time is preferably a hundred to a thousand times longer than the changeover time. For example, the changeover time may be in the range of 10 to 100 microseconds or up to 10 milliseconds, and the waiting time in the range of 50 to 100 milliseconds or up to 500 milliseconds.

The input method for an electronic circuit is used with the switches, input lines, and pull circuits described above, and comprises the steps of a status evaluation logic determining the status of the third switch by repeatedly activating, for first time periods, the first pull circuit and, for second time periods, the second pull circuit, determining, during the first time periods, the voltage of the second input line, and, during the second time periods, the voltage of the first input line, and indicating that the third switch is closed either if and only if said voltages both are substantially equal to the common reference voltage, with the first and second reference voltage being equal to the common reference voltage, or if during the first time periods, a signal on the second input line corresponds to a signal determined by the first pull circuit, or, if during the second time periods, a signal on the first input line corresponds to a signal determined by the second pull circuit.

In a further preferred embodiment of the invention, the hearing instrument comprises, as electrical input elements, preferably as part of the lid, a first switch and a second switch, the first switch being arranged to connect a first input line and a second input line via a second resistance, and the second switch being arranged to connect the first input line and the second input line via a first resistance, the values of the first resistance and second resistance being different.

As a result, the impedance between the first input line and the second input line is equal to the second resistance when first switch is closed, i.e. conducting, and is equal to the first resistance when the second switch is closed. These different impedances are chosen to differ enough so that they are reliably detectable by an input circuit of the hearing instrument. This input circuit constitutes a means for detecting, based on a resistance measured between the first input line and second input line, the state of the switches, i.e. which of the switches is closed.

In further preferred embodiments of the invention, further switches are arranged to cause further, different impedance values, including e.g. a zero impedance, to show up between the two input lines.

In a further preferred embodiment of the invention, the first switch and second switch are implemented as a see-saw switch having a single conducting element that is movable, e.g. slidable or rotatable, to alternately connect one of two pairs of pair wise opposing contacts: The contact pairs are e.g. either opposed to one another, so that the conducting element can slide in a parallel movement from contacting the first pair to contacting the second pair. Alternatively, the contact pairs are opposed to one another in a crossed-over configuration, so that the conducting element is rotatable from contacting the first pair to contacting the second pair.

The first input line is connected to a first contact terminal and the second input line is connected to a second contact terminal of the lid. Alternatively, the second input line is connected or to one of the terminals of a battery lying in the battery compartment. The battery terminals are connected to the hearing instrument body by further contacts, and so the one of these further contacts that is connected, via the battery terminal, to the second input line, replaces one of the contact terminals.

In a further preferred embodiment of the invention, at least one of the input elements is an analog input element, such as an analog wheel, which changes the value of a variable resistor arranged in the lid, and in this way is functionally associated with the impedance between the lid contact terminal and a further terminal. Accordingly, the hearing instrument comprises means to infer the presence and the state of the analog input element from the impedance. The range of resistance of the variable resistor is chosen in accordance with the other resistors and input means of the lid such that the interpretation of impedances observed at the input terminals is unambiguously defined.

In a further preferred embodiment of the invention, the cover lid may be one of a plurality of different types of cover lids, and the hearing instrument comprises means to detect of which type the cover lid is. The different types of cover lids may be distinguishable by a specific impedance or electrical property that shows up between two specific terminals. This impedance may be dependent on whether one of the input elements is activate, or the impedance may be independent of the state of the input elements. The impedance, as in other cases, may depend on the polarity of the voltage applied to the input lines, e.g. by incorporating one or more diodes in series with corresponding resistances.

In this manner it is possible for the hearing instrument distinguish between a plurality of different lid types, which can be exchanged by the audiologist or the end user. The hearing instrument recognises the lid type and automatically interprets the impedance or other signals observed at the lid terminals according to the lid type, providing so-called "Plug and Play" functionality.

In addition to providing different user input means, such different types of cover lids can e.g. comprise

- a receiver coil for receiving inductive signals;
- a control receiver for receiving external control signals;
- a radio receiver for receiving public radio signals such as FM radio.

In a preferred embodiment of the invention, the internal configuration and the manner of operation of the hearing instrument is adapted according to the type of the lid. For example, when a lid with a receiver coil is inserted, the hearing instrument software is automatically configured to periodically monitor for any signals from the receiver coil and to switch to coil input mode when a signal is detected.

Thus, the end user is offered a complete range of different options from which he may select, without requiring connection to a fitting or programming software or even a mechanically modification of the hearing instrument (except for exchanging the lid). This concept of exchanging lids, detecting the lid type and adapting the operation of the hearing instrument accordingly is independent of the particular configuration of input devices (switches, resistors) as described further above, and may also be implemented without any input devices being present on the lid.

A corresponding method for operating a hearing instrument implements the steps of

- detecting that a lid (or in more general terms: an exchangeable part of the hearing instrument) has been mechanically joined to the hearing instrument, e.g. by snapping it onto the hearing instrument.
- identifying the type of the lid; for example according to a resistive or a general impedance observed at electrical contact terminals that connect the lid to the hearing instrument;
- and at least one of the following steps:
  - adapting the mode of operation of the hearing instrument in accordance with the type of the lid;
  - interpreting signals received from the lid in accordance with the type of the lid;
  - applying an electrical signal to the abovementioned or other contact terminals of the lid, measuring other electrical quantities at contact terminals of the lid and processing or interpreting these other quantities in accordance with the type of the lid.

In further preferred embodiment of the invention, the hearing instrument further comprises means to detect whether a programming connector instead of a cover lid is connected to the device contact terminals. As in the case of distinguishing between different types of lids, this differentiation may be accomplished by having the impedance between contact terminals and possibly battery terminals code for the presence of a programming connector. The means for determining the type of lid or for determining whether a programming connector is present therefore may simply be an circuit for determining an impedance value or for determining whether the impedance is within a predetermined range.

Further preferred embodiments are evident from the dependent patent claims. Features of the method claims may be combined with features of the device claims and vice versa.

BRIEF DESCRIPTION OF THE DRAWINGS

The subject matter of the invention will be explained in more detail in the following text with reference to preferred exemplary embodiments which are illustrated in the attached schematic drawings, in which.

The reference symbols used in the drawings, and their meanings, are listed in summary form in the list of reference symbols. In principle, identical parts are provided with the same reference symbols in the figures.

DETAILED DESCRIPTION OF PREFERRED EMBODIMENTS

Figure 1:
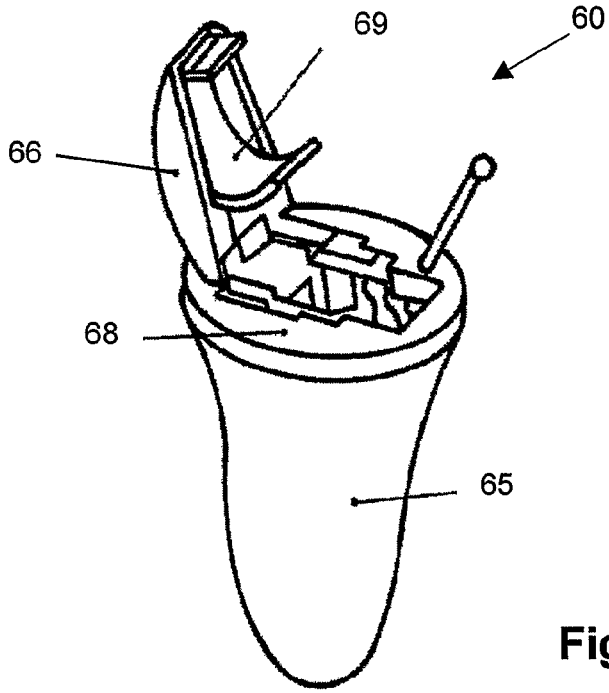
FIG. 1 shows a hearing instrument with its battery compartment lid opened.

FIG. 1 shows a hearing instrument 60 with its battery compartment lid opened. The hearing instrument 60 comprises a hearing instrument body 65 that can be inserted into the ear canal of the user. On the hearing instrument body 65, or as part of the body 65, a plate 68 is arranged, in which microphones, input devices and an openable or removable lid 66 are arranged. In this example, the lid 66 is a lid of a battery compartment, and the lid 66 comprises a battery clamp 69 for holding a battery for powering the hearing instrument.

Figure 2:
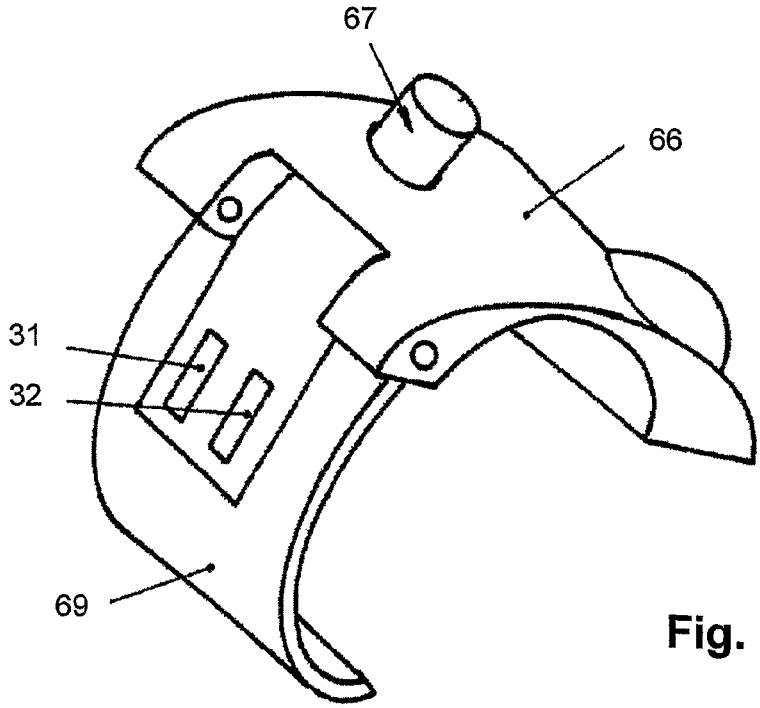
FIG. 2 shows the battery compartment lid.
Figure 3:
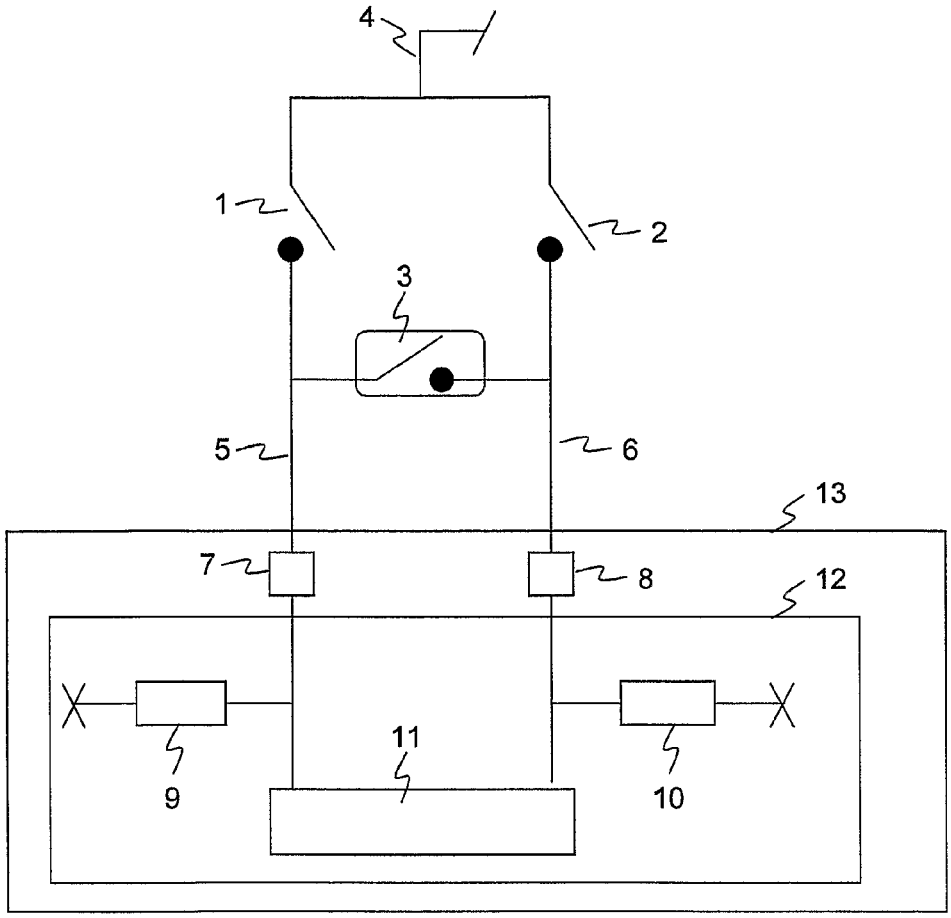
FIG. 3 schematically shows an input arrangement for a circuit according to a preferred embodiment of the invention.

FIG. 2 shows the battery compartment lid 66 in more detail. On the outer surface of the lid 66 an electrical or electromechanical input means such as a button 67 is arranged, such that it can be operated when the lid 66 is in a closed position. On the battery clamp 69, two contact terminals 31, 32 are arranged. When the lid 66 is closed, the contact terminals 31, 32 are brought into contact with correspondingly arranged body contact terminals of the hearing instrument body 65. The status of the button 67 can be inferred via the contacts. If there are several buttons or other input elements, this is done by appropriate circuitry in the hearing instrument body 65, as is described by the following different exemplary preferred embodiments:

FIG. 3 schematically shows an input arrangement for a circuit: A first switch 1 and a second switch 2 constitute a pair of switches of which only one switch is closed at any given time, such as in a seesaw switch or digital wheel. The first switch 1 and second switch 2 are arranged to connect, respectively, a first input line 5 and a second input line 6 to a common reference voltage bus 4, shown here to be connected to ground. A third switch 3 is arranged between the first input line 5 and the second input line 6. The input lines are connected to an electronic circuit 13 by means of a first and second bonding pad 7, 8 respectively. The electronic circuit 13 is typically a hybrid circuit comprising digital and analog elements, including a digital chip or integrated circuit (IC) 12. The integrated circuit 12 comprises port circuitry 11 for the input lines 5, 6.

Alternatively, the switches 1, 2, 3 may be arranged on a lid 66, with the contacts between the lid 66 and the hearing instrument body 65 taking the place of the bonding pads 7, 8. The purpose and function of the arrangement is the same in both cases, i.e. tom minimise the number of input lines used to determine the state of a plurality of input elements.

The port circuitry 11 may comprise standard circuits provided as a general purpose input/output (GPIO) building block during IC chip design. Such standard IO circuits typically comprise a pull-up resistor 9, 10 for each line and may be reconfigured during operation to operate as either input or output. In the context of this application, the lines are used for inputting information from the switches, which is why they are called input lines, although they are, for short periods of time, driven as outputs.

Figure 4:
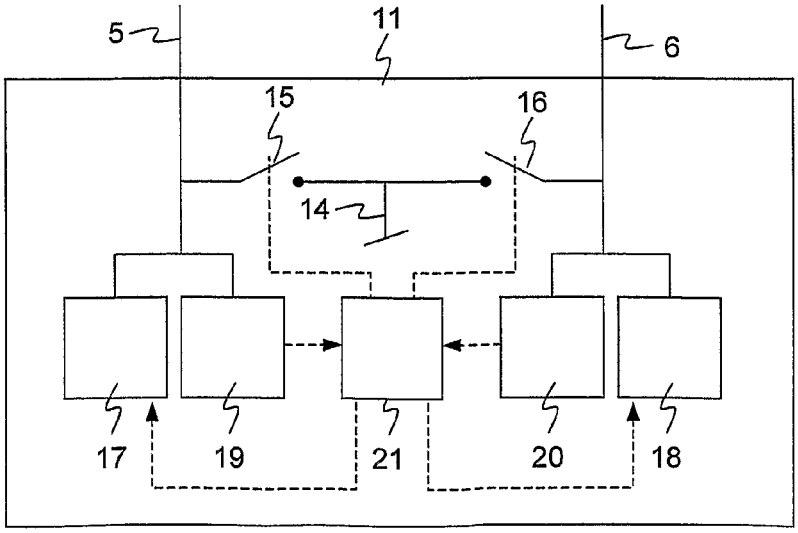
FIG. 4 schematically shows details of a port circuit according to a preferred embodiment of the invention.

FIG. 4 schematically shows details of a port circuit. An electronically controllable first pull-down switch 15 is arranged to connect the first input line 5 to an internal reference voltage bus 14. A first output circuit 17 for driving the line as an output and a first input circuit 19 for determining the voltage of the line are connected to the first input line 5. The first pull-down switch 15 and first output circuit 17 may be implemented alternatively: In order to pull the voltage of a line to a predetermined level, either 1. the corresponding IO circuit is controlled to operate as an output, and the output circuit 17 is set to output the predetermined voltage, or
2. the first pull-down switch 15 is closed, forcing the line to the level of the internal reference voltage bus 14.

The first alternative is easiest to implement with standard GPIO blocks. The first pull-up resistor 9 and the first output circuit 17 then constitute a first pull circuit. If the second alternative is implemented, the first pull circuit comprises the first pull-up resistor 9 and the first pull-down switch 15. Corresponding circuit elements are used for the second input line 6, i.e. a second pull-down switch 16, a second output circuit 18 and a second input circuit 20. The pull-down switches 15, 16 or output circuits 17, 18 are controlled by a status evaluation logic 21. The status evaluation logic 21 also reads the input voltage values determined by the input circuits 19, 20.

The first, second and third switches 1, 2, 3 are arranged externally to the electronic circuit 13, and the evaluation circuit 21 and pull circuits 9, 10, 15, 16 are arranged on the electronic circuit 13. The switches may, in principle, be engaging or non-engaging, ordinary relays, reed-relays etc. In a preferred embodiment of the invention, the first and second switch 1, 2 are used mainly for volume control and the third switch 3 as a telephone coil switch.

In a further preferred embodiment of the invention, the reference voltage bus 4 and the internal reference voltage bus 14 of the integrated circuit 12 are connected and carry the same voltage. In the figures they are shown connected to ground. They may however carry an arbitrary other reference voltage that is different from the voltage to which the input lines 5, 6 are pulled when the pull circuits are not activated.

It is also possible, when activating a pull circuit, to pull the line voltage to an other predefined voltage that is different from the reference voltage and to test whether the voltage on the opposite line is influenced, that is, substantially different from the voltage of the opposite line in its not activated state. This influence is caused by the third switch being closed, or by the switch of said opposite line being closed. For the second case, checking the other line voltage decides the case.

In both cases just mentioned, the first and second reference voltage may be different from the common reference voltage, and/or the signals determined by the input lines by the pull circuits may be either constant voltages, or time-varying signals having a predetermined pattern. For this purpose and also in general, the pull circuits may also be constituted by circuit elements that all are residing on the integrated circuit integrated circuit 12, i.e. without external pull-up resistors 9, 10.

Thus, at least one of the signal determined by the first pull circuit 9, 15 and the signal determined by the second pull circuit 10, 16 is a constant voltage value different from the common reference voltage. The correspondence between two signals, i.e. between the signal determined by the first pull circuit 9, 15 and measured on the second input line 6 or vice versa, is determined by checking whether the two signal voltages are essentially the same.

Alternatively, or in combination, at least one of the signal determined by the first pull circuit 9, 15 and the signal determined by the second pull circuit 10, 16 is a time-varying voltage. Here the correspondence of two signals is determined by checking whether their trajectories over time are essentially the same. For example, one of the outputs controlling the lines 5, 6 may control or switch the line to be repeatedly "zero" for 10 microseconds and then "one" for 20 microseconds and so on. Of course, any other binary or analog trajectory is possible. The trajectory must be known to the analysis logic of the other line. If an output trajectory and the measured input trajectory at the other line are essentially equal, then the third switch is known to be closed. If they are not equal, then either the third switch is open, or one of the following cases has occurred:

If the input voltages measured at both lines 5, 6 are equal to the common reference voltage, then the third switch 3 and one of the first switch 1 and second switch 2 are closed. If the input voltage at the first input line 5 is equal to the common reference voltage and the voltage at the second input line 6 is unaffected, i.e. is equal to the voltage of the inactivated second pull circuit 10, 16, then the first switch 1 is closed and the third switch 3 is open. If the input voltage at the second input line 6 is equal to the common reference voltage and the voltage at the first input line 5 is unaffected, i.e. is equal to the voltage of the inactivated first pull circuit 9, 15, then the second switch 2 is closed and the third switch 3 is open.

As long as the first switch 1 and second switch 2 are open, a single first time period or a single second time period suffices to determine the state of the third switch 3.

Figure 5:
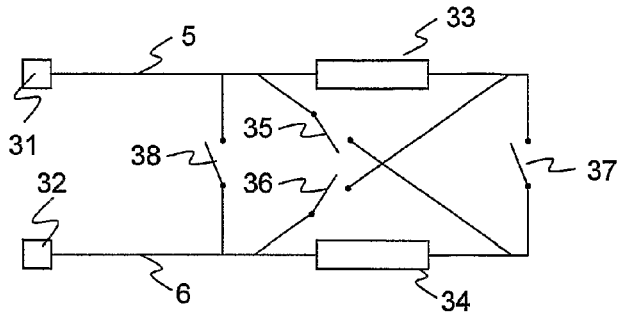
FIG. 5 schematically shows an input arrangement according to a further preferred embodiment of the invention.

FIG. 5 schematically shows an input arrangement as part of the lid 66 according to a further preferred embodiment of the invention. The first input line 5 electrically connects the first contact terminal 31 with a first terminal of a first resistance 33. The second input line 6 connects the second contact terminal 32 with a first terminal of a second resistance 34. The first input line 5 and the second terminal of the second resistance 34 are connected over a first switch 35. The second input line 6 and the second terminal of the first resistance 33 are connected over a second switch 36. The second terminals of the first resistance 33 and second resistance 34 are connected by a third switch 37. In a preferred embodiment of the invention, the first input line 5 and second input line 6 are connected over a fourth switch 38. The value of the first resistance 33 and the second resistance 34 are sufficiently different that the circuitry of the associated hearing instrument 60 can differentiate among them. Assuming than only one of the switches is closed, i.e. conducting, at any given time, the impedance observed between the first contact terminal 31 and second contact terminal 32 uniquely indicates which one of the switches is closed, if any. The hearing instrument 60 comprises means for detecting, based on an impedance measured between the first input line 5 and second input line 6, which of the switches is closed, i.e. conducting.

Figure 6:
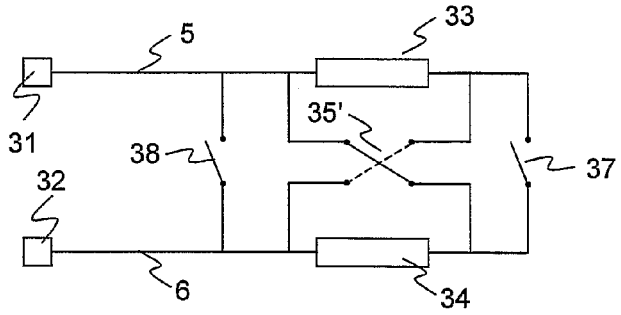
FIGS. 6-7 schematically show variants of this input arrangement.
Figure 7:
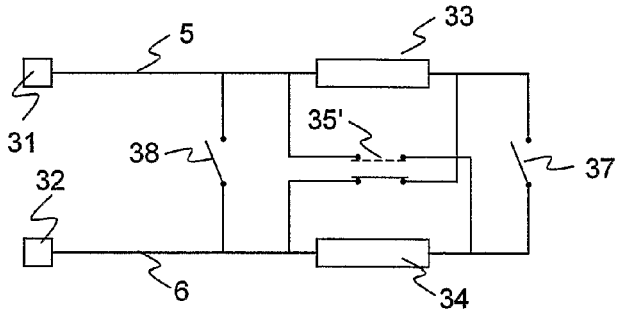

FIG. 6 schematically shows a variant of the input arrangement according to FIG. 5. Here the first switch 35 and second switch 36 are replaced by a double switch 35'. The double switch 35' effects by its electromechanical construction that only one of the two connections is conducting at any given time. According to FIG. 6, the double switch 35' comprises a rotatable conducting element that may be rotated from a first position connecting the first input line 5 to the second terminal of the second resistance 34 to a second position connecting the second input line 6 to the second terminal of the first resistance 33. According to FIG. 7, the double switch 35' comprises a slidable conducting element that may be moved from a first position connecting the first input line 5 to the second terminal of the second resistance 34 to a second position connecting the second input line 6 to the second terminal of the first resistance 33.

Figure 8:
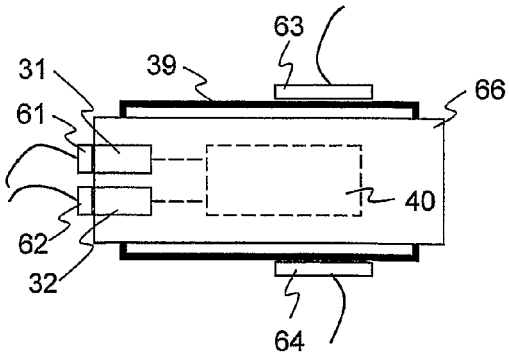
FIGS. 8-9 schematically show variants of electrical connections to a lid comprising a battery.
Figure 9:
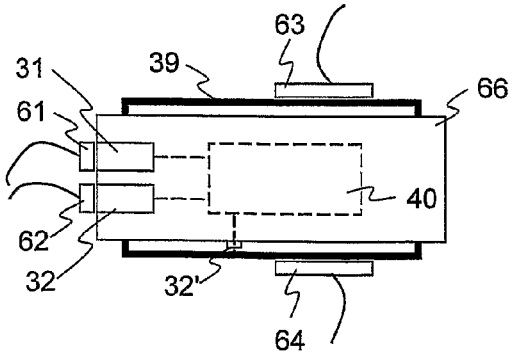

FIGS. 8-9 schematically show variants of electrical connections to a lid 66 comprising a battery. The lid 66 comprises the input arrangement 40 connected to the first contact terminal 31 and second contact terminal 32. When the lid 66 is in the closed position, the contact terminals are in electrical contact with a first body contact 61 and a second body contact 62 respectively of the hearing instrument body 65 (not shown in the figure). The lid 66 holds the battery 39 which in the closed position of the lid 66 electrically contacts with its positive and negative terminals a first battery contact 63 and a second battery contact 64 respectively of the hearing instrument body 65. In the embodiment according to FIG. 9 there is an electrical connection between the input arrangement 40 and one of the battery terminals. This connection may be accomplished by a further contact terminal 32' making contact with the outer rim of the battery, which is part of one of the battery terminals. This arrangement allows to transmit additional information from the lid 66 to the hearing instrument body 65. This is done e.g. by connecting in the input arrangement 40 one of the first contact terminal 31 and second contact terminal 32 with the further contact terminal 32'. Thus, in addition to having the impedance between the first and second contact terminals 31, 32 as information carrier, the impedance between one of these contact terminals and one of the battery contacts 63, 64 of the hearing instrument body 65 is also used to carry information as well. In further preferred embodiments of the invention, described further below, this information is used to determine whether a battery-holding lid 66 or a programming plug 55 is inserted in the hearing instrument body 65.

Figure 10:
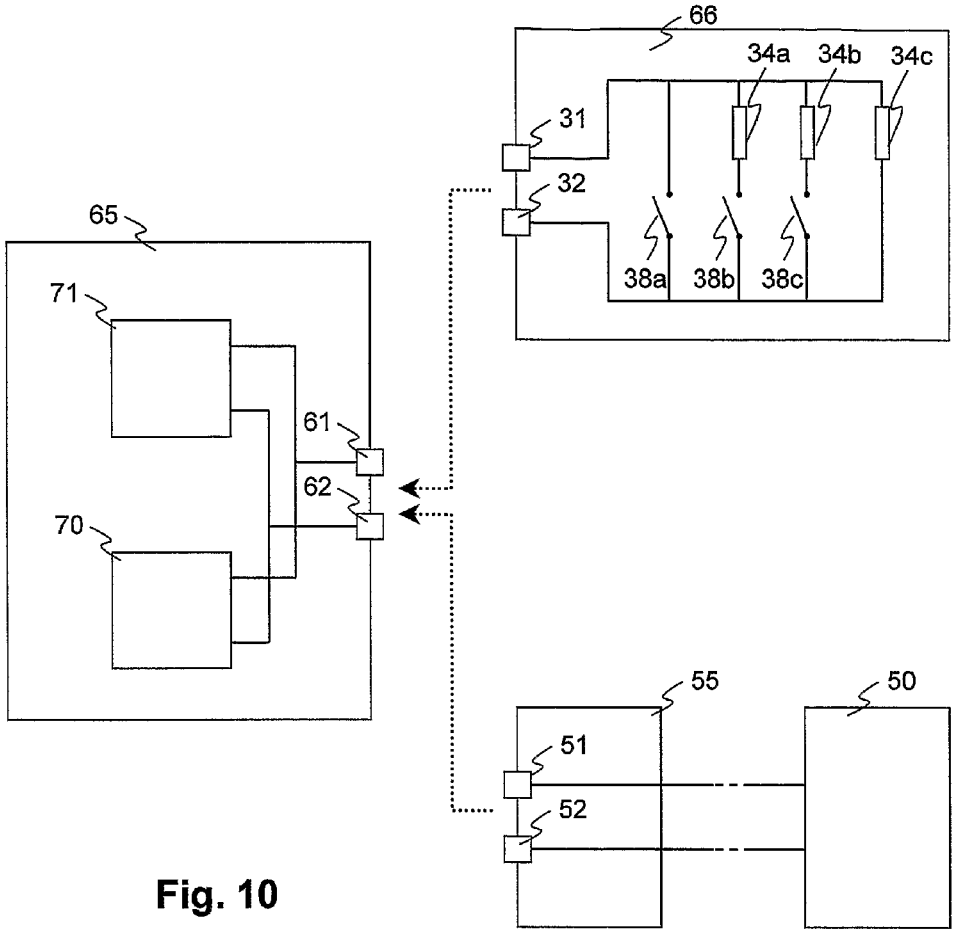
FIG. 10 schematically shows a lid or a programming device being connectable to a hearing instrument body.

FIG. 10 schematically shows a lid or a programming device being connectable to a hearing instrument body 65. The arrows symbolize that either a lid 66 carrying a battery 39 or a programming plug 55 of a programming device 50 may be inserted in the hearing instrument body 65. In both cases, the battery contacts 63, 64 of the hearing instrument body 65 are powered by either the battery terminals or by a correspondingly arranged first power terminal 53 and second power terminal 54 of the programming plug 55. The body contacts 61, 62 of the hearing instrument 60 make contact with the contact terminals 31, 32 of the lid 66, or with programming plug contacts 51, 52 respectively. The hearing instrument body 65 comprises both an analog I/O circuit 70 and a digital I/O or communication circuit 71. FIG. 10 also shows a further variant of the internals of the input arrangement 40 of the lid 66: Further switches 38*a*, 38*b*, 38*c* are arranged to connect the first contact terminal 31 and second contact terminal 32 over further resistors 33*a*, 33*b*, 33*c* having different values.

When the hearing instrument 60 is powered up, it may be that either a programming plug 55 or a lid 66 carrying a battery 39 is inserted. The hearing instrument 60 must determine which is the case, since in the first case it will have to establish a communication link over the two (or more) contacts 61, 62. There are several approaches to how this may be done. In general terms, this is done by determining electric properties of the unidentified circuit connected to the contact terminals 61-64. The same approach may be used, if different lid types are provided, to determine the type of the lid.

In a first preferred embodiment of the invention, the impedance of the lid 66 comprises a special value that does not occur when a programming device 50 is connected, and that can be tested for by the hearing instrument 60. In particular, this impedance may be asymmetric, e.g. a diode connecting the first contact terminal 31 and second contact terminal 32 over a resistance. The hearing instrument 60 applies, through its analogue I/O circuit 70, a voltage and a voltage with inverted polarity to the input lines 5, 6. If different currents are measured, then the presence of the diode and therefore the lid 66 with the input arrangement 40 is established, and the correct polarity for determining the switch status from then on is known as well. The analogue I/O circuit 70 will continue to determine the input impedance intermittently in order to determine the status of the various input means of the input arrangement 40. If the presence of the programming plug 55 is established, the digital I/O circuit 71 shall establish communication, using known protocols such as I2C or NoahLink or HIPRO.

In further preferred embodiments of the invention, the differentiation between battery operation and programming is made by pulling one of the input lines to a specific voltage level such as e.g. the level of the positive or negative power terminal. This and the previous approach may also be used to distinguish between different lids comprising different input means, e.g. toggle switches instead of analog wheels, more or less switches or pushbuttons, etc.

Figure 11:
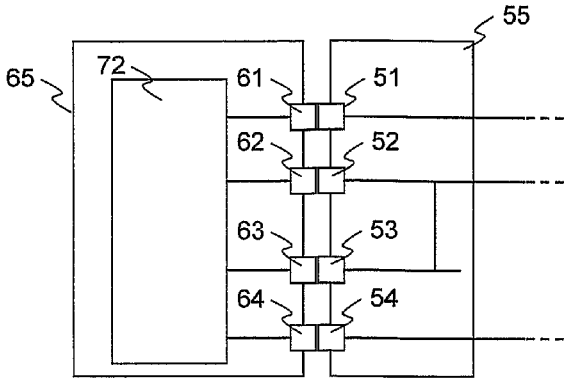
FIGS. 11-12 schematically show arrangements to make different lids and programming plugs distinguishable.
Figure 12:
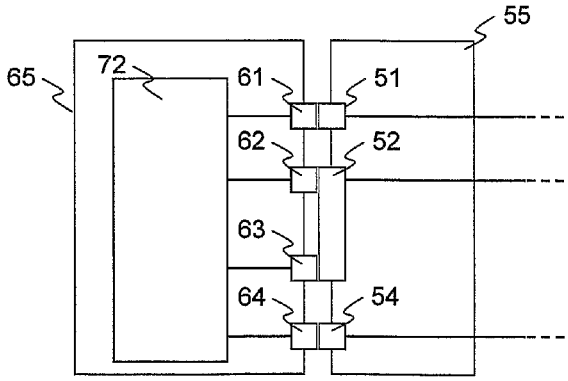

FIGS. 11-12 schematically show such arrangements to make different lids and programming plugs distinguishable. According to the embodiment of FIG. 11, one of the input lines is connected, in the programming plug 55, to a first power terminal 53 which contacts the first battery contact 63 of the hearing instrument body 65. According to the embodiment of FIG. 12, the same electrical connection is established by the second programming plug contact 52 being physically arranged to contact both one of the body contacts 62 and one of the battery contacts 63. In both embodiments, the electronic circuitry 72 of the hearing instrument 60 will detect that the second body contact 62 is on the same voltage level as the first battery contact 63.

Figure 13:
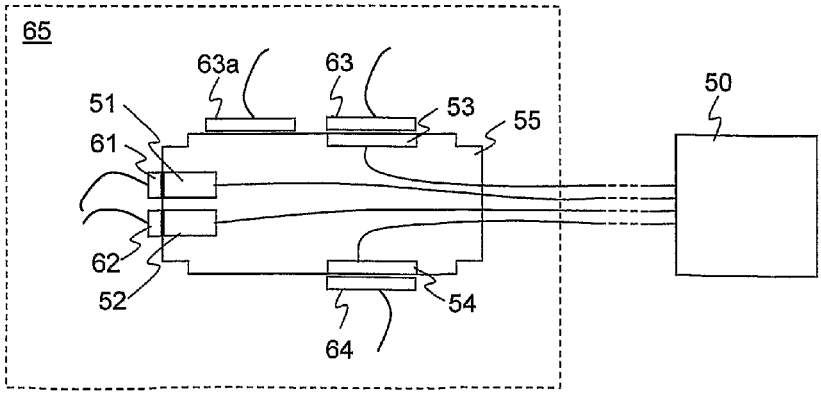
FIG. 13 schematically shows a programming device connected to a hearing instrument body.

FIG. 13 schematically shows a programming device connected to a hearing instrument body. Here the hearing instrument body 65 comprises a sensing contact 63*a*. The programming plug 55 comprises no further contacts than the programming plug contacts 51, 52 and power terminals 53, 54. One of the power terminals 53, 54 is arranged to contact e.g. only the first battery contact 63 but not the adjacent sensing contact 63*a*. When a lid 66 carrying a battery 39 is in place of the programming plug 55, as in FIGS. 8 and 9, then one of the terminals of the battery 39 will establish a contact not only to the first battery contact 63 but also to the sensing contact 63*a*, allowing the hearing instrument 60 to determine the presence of the battery 39.

Figure 14:
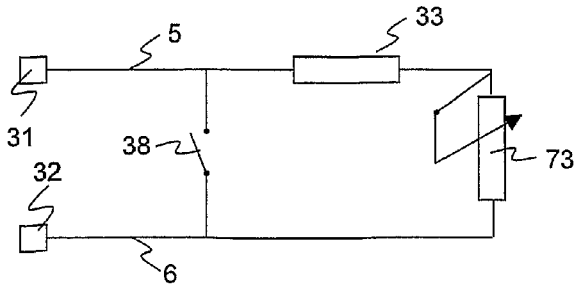
FIG. 14 schematically shows a further input arrangement.

FIG. 14 schematically shows an input arrangement as part of the lid 66 according to a further preferred embodiment of the invention. The input arrangement comprises a variable resistor 73 whose value is modified by an analog input device such as an analog wheel The impedance observed at the contact terminals 31, 32 indicates the status of the switch 38 (impedance zero) or the position of the analog input device (any other impedance). The additional first resistor 33 allows to distinguish the state in which the variable resistor has zero resistance from the state in which the switch 38 is closed.

In principle, the other input arrangements according to FIGS. 5 to 13 can also be used with one resistor being a variable resistor. The range of its resistance values is chosen such that all different states and resistance values can be distinguished unambiguously. This can be done e.g. (in the conceptually simplest manner) by adding, in one of said input arrangements, a variable resistor in series to one of the resistor, with the resistance range of the variable resistor being small with respect to the resistance of the other, nonvariable resistors.

Although the features and advantages of the invention are explained in terms of hearing instruments, they may be applied in an analogous fashion to arbitrary other devices in which the objects according to the invention arise.

List of Designations

1 first switch
2 second switch
3 third switch
4 reference voltage bus
5 first input line
6 second input line
7 first bonding pad
8 second bonding pad
9 first pull-up resistor
10 second pull-up resistor
11 port circuit
12 integrated circuit
13 hybrid circuit
14 internal reference voltage bus
15 first pull-down switch
16 second pull-down switch
17 first output circuit
18 second output circuit
19 first input circuit
20 second input circuit
21 status evaluation logic
31 first contact terminal
32 second contact terminal
33 first resistance
34 second resistance
34*a, b, c* further resistances
35 first switch
35' double switch
36 second switch
37 third switch
38 fourth switch
38*a, b, c* further switches
39 battery
40 input arrangement
50 programming device
51 first programming plug contact
52 second programming plug contact
53 first power terminal
54 second power terminal
55 programming plug
60 hearing instrument
61 first body contact
62 second body contact
63 first battery contact
64 second battery contact
65 hearing instrument body
66 lid

67 button
68 plate
69 battery clamp
70 analog I/O circuit
71 digital I/O circuit
72 electronic circuitry
73 variable resistor

The invention claimed is:

1. A hearing instrument comprising an openable cover lid, the cover lid comprising at least one electrical input element, at least one lid contact terminal arranged to physically and electrically contact at least one corresponding device contact terminal when the lid is in a closed position, and an input arrangement for an electronic circuit, characterised in that the cover lid comprises at least two electrical input elements, each of the at least two input elements being functionally associated with the impedance between the lid contact terminal and a further terminal, the hearing instrument comprises means to infer the state of the input elements from said impedance, and the input arrangement comprises:

a first input line and a second input line, a first switch and a second switch, wherein the first switch being configured to connect, in a closed position, the first input line to a common reference voltage, the second switch being configured to connect, in a closed position, the second input line to the common reference voltage, and the first and second switch being arranged such that during normal operation of the circuit at most one of them is in the closed position, a third switch arranged to connect, in a closed position, the first input line with the second input line, a first pull circuit configured to pull, when it is activated, the voltage of the first input line to a first reference voltage, and to pull, when it is not activated, the voltage of the first input line to a voltage different from the first reference voltage, and a second pull circuit configured to pull, when it is activated, the voltage of the second input line to a second reference voltage, and to pull, when it is not activated, the voltage of the second input line to a voltage different from the second reference voltage, and a status evaluation logic configured to determine the status of the third switch by repeatedly activating, for first time periods, the first pull circuit and, for second time periods, the second pull circuit and by determining, during the first time periods, the voltage of the second input line, and, during the second time periods, the voltage of the first input line, and by indicating that the third switch is closed either, if and only if said voltages both are substantially equal to the common reference voltage, with the first and second reference voltage being equal to the common reference voltage, or, if during the first time periods, a signal on the second input line corresponds to a signal determined by the first pull circuit, or, if during the second time periods, a signal on the first input line corresponds to a signal determined by the second pull circuit.

2. The hearing instrument of claim 1, wherein the number of input elements is equal to or larger than the number of lid contact terminals.

3. The hearing instrument of claim 1, wherein the lid is the lid of a battery compartment of the hearing instrument, and in a closed position of the lid at least one of the input elements is in electrical contact with one of the terminals of a battery lying in the battery compartment.

4. The hearing instrument of claim 1, wherein the first switch and the second switch constitute a pair of switches which are operatively connected such that at most one of them is in the closed position, and which preferably are part of a digital wheel or of a seesaw switch.

5. The hearing instrument of claim 1, comprising an evaluation circuit for storing an input value, for increasing said input value when the first switch is closed and for decreasing said input value when the second switch is closed.

6. The hearing instrument of claim 1, wherein the first and second switch are arranged external to the electronic circuit, and the evaluation circuit and pull circuits are arranged on the electronic circuit.

7. The hearing instrument of claim 1, wherein the first and second time periods are shorter than the shortest time span for which the first switch-and second switch are closed during normal operation, preferably at least 10 to 100 times shorter.

8. The hearing instrument of claim 1, wherein at least one of the signal determined by the first pull circuit and the signal determined by the second pull circuit is a constant voltage value different from the common reference voltage, and wherein the correspondence of two signals is determined by checking whether the two signal voltages are essentially the same.

9. The hearing instrument of claim 1, wherein at least one of the signal determined by the first pull circuit and the signal determined by the second pull circuit is a time-varying voltage, and wherein the correspondence of two signals is determined by checking whether their trajectories over time are essentially the same.

10. A hearing instrument comprising an openable cover lid, the cover lid comprising at least one electrical input element and at least one lid contact terminal arranged to physically and electrically contact at least one corresponding device contact terminal when the lid is in a closed position, characterised in that the cover lid comprises at least two electrical input elements, each of the at least two input elements being functionally associated with the impedance between the lid contact terminal and a further terminal, the at least two electrical input elements comprise a first switch and a second switch, the first switch being arranged to connect a first input line and a second input line via a second resistance, and the second switch being arranged to connect the first input line and the second input line via a first resistance, the values of the first resistance and second resistance being different and in that the hearing instrument comprises means to infer the state of the input elements from said impedance, wherein the first switch and the second switch are coupled such that only one of them can be in the conducting state at any given time, the hearing instrument comprising as further input element a third switch arranged to connect the first input line and the second input line via both the first resistance and the second resistance.

11. The hearing instrument of claim 10, wherein the first switch and second switch are implemented as a see-saw switch having a single conducting element that is movable, and preferably rotatable, to alternately connect one of two pairs of contacts.

12. The hearing instrument of claim 10, comprising as further input element a fourth switch arranged to connect the first input line and the second input line via a further resistance, preferably a zero resistance.

13. The hearing instrument of claim 10, wherein the first input line is connected to a first contact terminal and the second input line is connected to a second contact terminal of the lid.

14. The hearing instrument of claim 10, wherein the one of the input lines is connected to a contact terminal of the lid and the other one of the input lines is connected to one of the terminals of a battery lying in the battery compartment.

15. The hearing instrument of claim 1, in which at least one of the input elements is an analog input element which changes the value of a variable resistor arranged in the lid, and in this way is functionally associated with the impedance between the lid contact terminal and a further terminal, and the hearing instrument comprises means to infer the state of the analog input element from the impedance.

16. A hearing instrument comprising an openable cover lid, the cover lid comprising at least one electrical input element and at least one lid contact terminal arranged to physically and electrically contact at least one corresponding device contact terminal when the lid is in a closed position, characterised in that the cover lid comprises at least two electrical input elements, each of the at least two input elements being functionally associated with the impedance between the lid contact terminal and a further terminal, and in that the hearing instrument comprises means to infer the state of the input elements from said impedance, wherein the cover lid may be one of a plurality of different types of cover lids, and the hearing instrument comprises means to detect of which type the cover lid is.

17. The hearing instrument of claim 16, wherein the hearing instrument is configured to adapt its internal configuration and functionality according to the type of cover lid that is present.

18. The hearing instrument of claim 17, in which the hearing instrument is configured to accept one of a plurality of different types of cover lids, where one of the types cover lids comprises at least one of the following:

a receiver coil for receiving inductive signals;

a control receiver for receiving external control signals;

a radio receiver for receiving public radio signals such as FM radio.

19. A hearing instrument comprising an openable cover lid, the cover lid comprising at least one electrical input element and at least one lid contact terminal arranged to physically and electrically contact at least one corresponding device contact terminal when the lid is in a closed position, characterised in that the cover lid comprises at least two electrical input elements, each of the at least two input elements being functionally associated with the impedance between the lid contact terminal and a further terminal, and in that the hearing instrument comprises means to infer the state of the input elements from said impedance, wherein the hearing instrument further comprises means to detect whether a programming connector instead of a cover lid is connected to the device contact terminals.

20. The hearing instrument of claim 16, wherein the means to detect of which type the cover lid, or whether a programming connector instead of a cover lid is connected to the device contact terminals, comprises means to determine a resistance observed between two device contact terminals or between one device contact terminal and a battery terminal.

21. An input method for a hearing instrument, the hearing instrument comprising an input arrangement for an electronic circuit, the electronic circuit comprising a first input line and a second input line, a first switch and a second switch, the first switch being configured to connect, in a closed position, the first input line to a common reference voltage, the second switch being configured to connect, in a closed position, the second input line to the common reference voltage, the first and second switch being operatively connected such that at any time at most one of them is in the closed position, the input arrangement further comprises a third switch arranged to connect, in a closed position, the first input line with the second input line, a first pull circuit configured to pull, when it is activated, the voltage of the first input line to a first reference voltage, and to pull, when it is not activated, the voltage of the first input line to a voltage different from the first reference voltage, a second pull circuit configured to pull, when it is activated, the voltage of the second input line to a second reference voltage, and to pull, when it is not activated, the voltage of the second input line to a voltage different from the second reference voltage, and comprising the steps of a status evaluation logic determining the status of the third switch by repeatedly activating, for first time periods, the first pull circuit and, for second time periods, the second pull circuit, determining, during the first time periods, the voltage of the second input line, and, during the second time periods, the voltage of the first input line, and indicating that the third switch is closed either, if and only if said voltages both are substantially equal to the common reference voltage, with the first and second reference voltage being equal to the common reference voltage, or if during the first time periods, a signal on the second input line corresponds to a signal determined by the first pull circuit, or, if during the second time periods, a signal on the first input line corresponds to a signal determined by the second pull circuit.

22. The input method of claim 21, wherein the first and second time periods are shorter than the shortest time span for which the first switch and second switch are closed during normal operation, preferably at least 10 to 100 times shorter.

23. The input method of claim 22, wherein the first time period is followed by a second time period after a very short changeover time, and then the next first time period follows after a longer waiting time, the waiting time being preferably a hundred to a thousand times longer than the changeover time.

* * * * *

UNITED STATES PATENT AND TRADEMARK OFFICE

CERTIFICATE OF CORRECTION

PATENT NO. : 8,437,488 B2
APPLICATION NO. : 12/664068
DATED : May 7, 2013
INVENTOR(S) : Ivo Hasler et al.

It is certified that error appears in the above-identified patent and that said Letters Patent is hereby corrected as shown below:

On the Title Page

In the Abstract, item (57), line 6, please add -- elements -- after "input"

Signed and Sealed this
First Day of October, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,437,488 B2
APPLICATION NO. : 12/664068
DATED : May 7, 2013
INVENTOR(S) : Hasler et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 726 days.

Signed and Sealed this
Eighth Day of September, 2015

Michelle K. Lee

Michelle K. Lee
*Director of the United States Patent and Trademark Office*